United States Patent [19]

Trogan

[11] 4,270,744

[45] Jun. 2, 1981

[54] TUCKERS ON MECHANICAL FOLDING ROLLS

[75] Inventor: John F. Trogan, Ashland, Wis.

[73] Assignee: C. G. Bretting Mfg. Co. Inc., Ashland, Wis.

[21] Appl. No.: 49,035

[22] Filed: Jun. 15, 1979

[51] Int. Cl.[3] ..... B65H 45/16

[52] U.S. Cl. ..... 493/430

[58] Field of Search ..... 270/39, 73

[56] References Cited

U.S. PATENT DOCUMENTS

| | | | |
|---|---|---|---|
| 1,595,992 | 8/1926 | Connard | 270/39 |
| 1,886,312 | 11/1932 | Stanton | 270/39 |
| 3,163,413 | 12/1964 | Franke | 270/73 |
| 3,214,162 | 10/1965 | Breidenbach | 270/39 |

*Primary Examiner*—Edgar S. Burr
*Assistant Examiner*—A. Heinz
*Attorney, Agent, or Firm*—Sherman Levy

[57] ABSTRACT

A method and means is provided for folding material such as paper hand toweling in either a single "V-fold" or multiple "Z-fold" configuration. In either case, the paper is forced by a tucker into a vise which consists of one stationary jaw and one movable jaw operated by a cam on opening and a spring mechanism on closing. The movable vise is leading through the roll nip. The tucker blade may be split into individual segments, the width of one towel rather than the full width of the machine. Further, leaf springs such as two leaf springs per segment rather than extension springs on each end of the blade are adapted to be used. The advantage of using such individual segments and leaf springs is that the problems or difficulties of machining one long blade without warpage, is overcome, and in addition, the replacement of one small segment in case of damage can be more easily replaced, and each segment can compensate for variation in paper thickness across the machine whereas with one blade the thickest material controlled the entire blade.

2 Claims, 10 Drawing Figures

57
51
60
60
57
51
47
57
22
78
60
60
76
75
57
51
57
77
60
47
82
81
58
51
59
57
80
47
79
48
83
48
59
61
62
60
53
55
48
50
49
54
57
22
50
47
56
52
57
49
58
48
52
58
57
47
51
84
60
59
61
62

TUCKERS ON MECHANICAL FOLDING ROLLS

BACKGROUND OF THE INVENTION

Field of the Invention

The present invention relates to folding apparatus, and more particularly to the folding of material such as paper or hand toweling in either a single fold ("V") or multiple fold ("Z") configuration. The paper is forced by a tucker into a vise which consists of a stationary jaw and a movable jaw operated by a cam on opening and a spring on closing. The movable vise is leading through the roll nip. The tucker on the bottom roll enters the vise on the top roll and the vise strips the sheet from the tuckers to make the first fold. Then the tucker on the top roll enters the vise on the bottom roll as they rotate to make another fold.

SUMMARY OF THE INVENTION

The present invention relates to tuckers on mechanical folding rolls. With a fixed tucker there must be designed a clearance at all times between the fixed vise and the tucker or there is direct mechanical interference. As the rolls wear or the roll centers are changed this clearance changes. If the rolls are rotated relative to each other (timed), the clearance between the first tucker and the fixed vise can be decreased but the next entering tucker vise combination will increase the same amount. The only way to compensate for this is to shim the tuckers out of the rolls and retime to control the clearance. If this clearance becomes too great, the sheet will tend to follow the tucker back out of the vise as the rolls rotate and cause a "dropped" fold. This becomes more common at higher speeds. Further, the shimming of the tuckers is a time-consuming procedure.

With the present invention the tucker blade is purposely designed and constructed to interfere several thousanths of an inch with the fixed anvil, and it can push away due to the spring loading. This makes the timing of the two rolls less critical for paper basis weight changes. It also traps the sheet between the fixed vise and the tucker so that the sheet is lees likely to follow the tucker as the tucker leaves the vise. This causes less "dropped" folds. Further, this eliminates the possibility of direct mechanical interference and allows running at higher speeds.

In accordance with the present invention, tuckers on mechanical folding rolls are provided in a highly advantageous manner with numerous advantages.

There are further provided other important features such as a special method of constructing the unit as well as the position of the parts. The primary object of the present invention is to provide tuckers on mechanical folding rolls that have improved characteristics and advantages as compared to previous such devices.

Still another object of the present invention is to provide tuckers on mechanical folding rolls wherein the apparatus is readily constructed and efficiently used and which is relatively simple and inexpensive to operate.

A still further object of the present invention is to provide tucker blades that are split into individual segments, the width of one towel rather than the full width of the machine, and wherein two leaf springs per segment rather than extension springs on each end of the blade can be used in one form of the invention. The advantage of this is that the difficulty of machining one long blade without warpage is overcome. Furthermore, replacement of one small segment in case of damage is assured, and wherein each segment can compensate for variation in paper thickness across the machine whereas with one blade the thickest material controlled the entire blade.

Other objects and advantages of the present invention will become apparent in the following specification when considered in the light of the attached drawings.

DESCRIPTION OF THE PREFERRED EMBODIMENT

Figure 1:
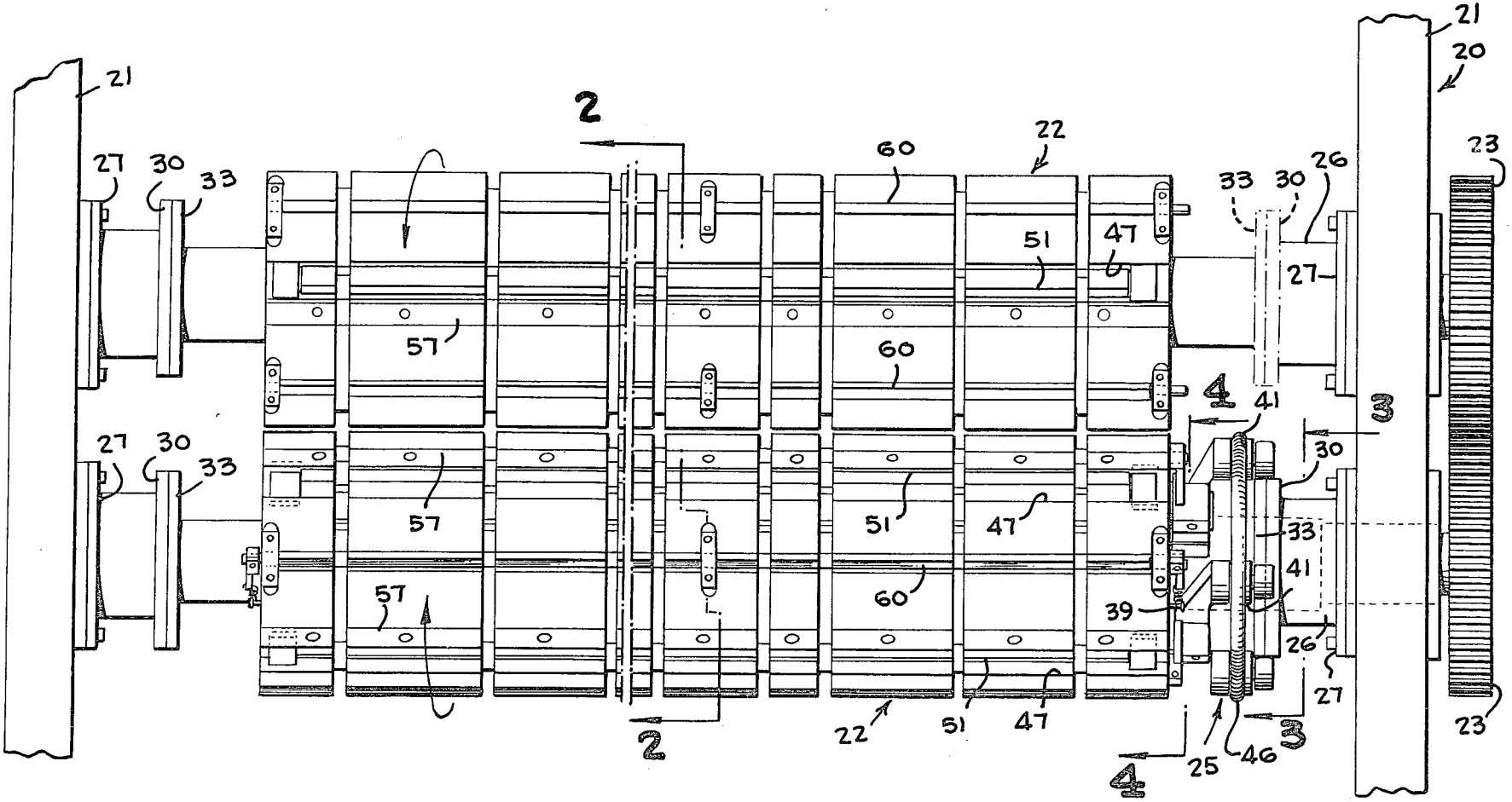
FIG. 1 is an elevational view illustrating the present invention.

Referring in detail to the drawings, and more particularly to FIGS. 1 through 5 of the drawings, there is shown a portion of a paper folding machine that includes a frame 20 that includes spaced apart frame pieces 21, and there is provided a pair of similar oppositely rotating coacting rolls 22 that are arranged adjacent each other. Gear means 23 are provided for rotating the rolls 22 in the proper direction, and reduced diameter shaft portions 24 are provided on the ends of the rolls 22. A cam mechanism 25 is provided for each of the shaft portions 24, and the cam mechanisms each include a sleeve portion 26 that has a plate or disc 27 integral therewith, and the plate portion 27 has arcuate slots 29 therein, FIG. 5, whereby securing elements 28 can be extended through th slots 29 and into engagement with the frame pieces 21 so that the cams 25 are fixedly secured in place. Due to the provisions of the arcuate slots 29, securing elements such as the screws 28 can be loosened so that the cams can be adjusted as desired relative to the remaining portion of the mechanism and then the screws can be tightened to hold the parts stationary in their adjusted position. Arranged in spaced parallel relation with respect to the plate portion 27 is a plate or disc 30 that has a cutaway cam surface 31 thereon, FIG. 5, and the member 30 has apertures 32 therein. There is further provided a cam member 33 that has arcuate slots 34 therein, and securing elements such as the screws 35 extend through the slots 34 and into engagement with the apertures 32 for fastening the elements 33 and 30 together. The member 33 has a circular opening 36 therein that registers with the hollow interior 37 of the cam sleeve 26, and the cam element 33 has a cam surface 38 on its outer periphery, as shown in the drawings.

Arm cam followers 39 are provided and each of the followers 39 include an arm 40 that has a cam element 41 on an end thereof for coaction with the cam surfaces 38 and 31. The cam arm follower 39 further includes a clamp 42 as well as flat end portions 43 that have openings 44 therein for the projection therethrough of securing elements such as screws. A spring member 46 is arranged in engagement with the cam portions 41 for biasing or urging the cam elements 19 into engagement with the cam surfaces 38 and 31, FIG. 3.

Each of the rolls 22 is provided with longitudinally extending recesses 47 therein, and gripper shafts 48 are mounted in the recesses 47. The gripper shafts 48 have cutaway portions 54 that are defined by first and second surfaces 49 and 50, FIG. 2. A movable gripper jaw or vise 51 is mounted in the cutaway or recessed portion 43, and the vise 51 includes an inclined outer surface 52. Openings 55 in the shaft 48 have securing elements such as the screws 53 extended therethrough for fastening the gripper 51 to the shaft 48.

There are further provided stationary anvils or stationary jaws or vises 57 that are mounted in recessed portion 56 in the rolls 22, and each of the stationary vises 57 has an inclined or beveled edge or surface 58 thereon.

The rolls 22 are further provided with L-shaped grooves 59, and tuckers 60 are mounted in the L-shaped grooves 59. The outer portions of the tuckers 60 have inclined surfaces 61 so that the outer end of the tuckers 60 terminate in a tip 62.

Figure 5:
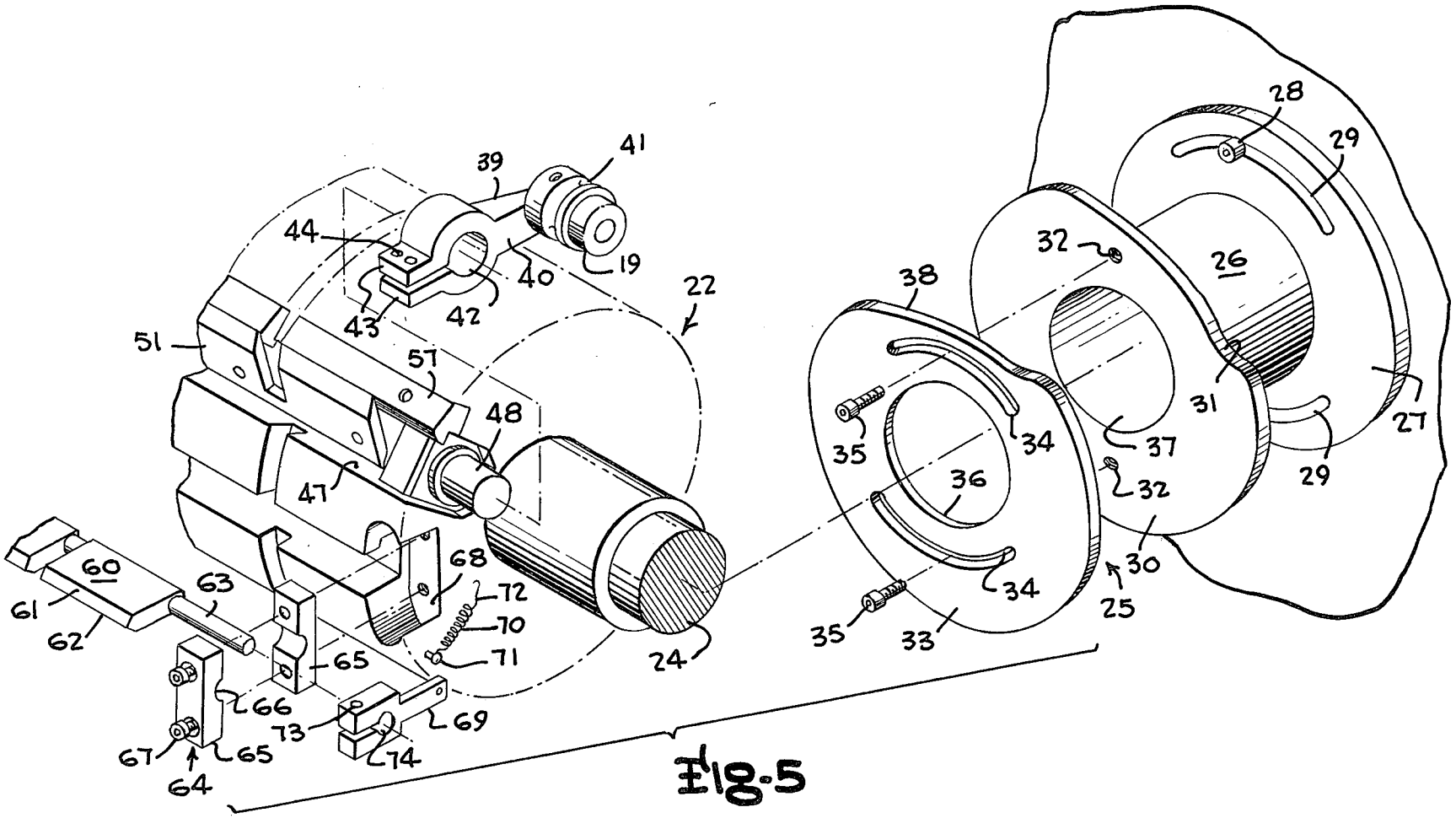
FIG. 5 is an exploded perspective view illustrating certain constructional details of the present invention.
Figure 6:
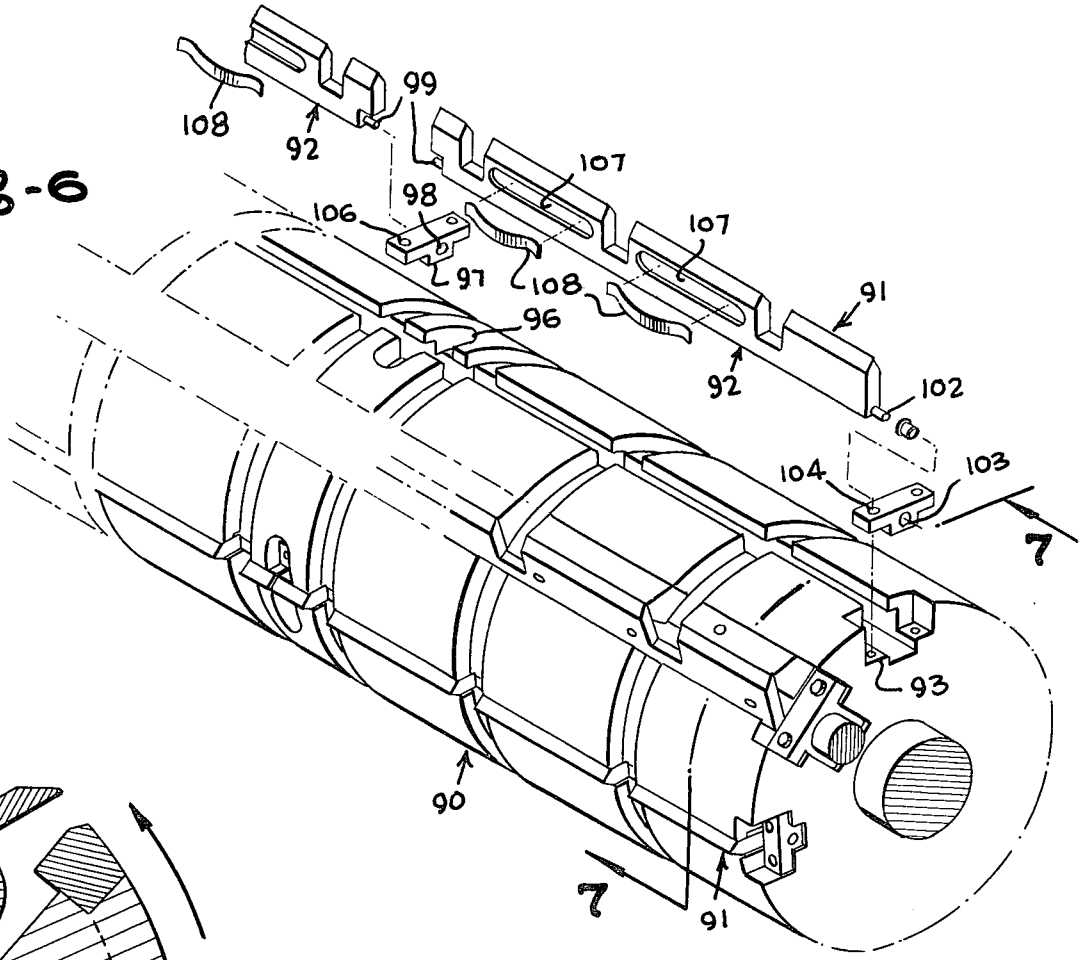
FIG. 6 is a diagrammatic perspective view of a folding roll with parts separated or exploded away for clarity of illustration.
Figure 7:
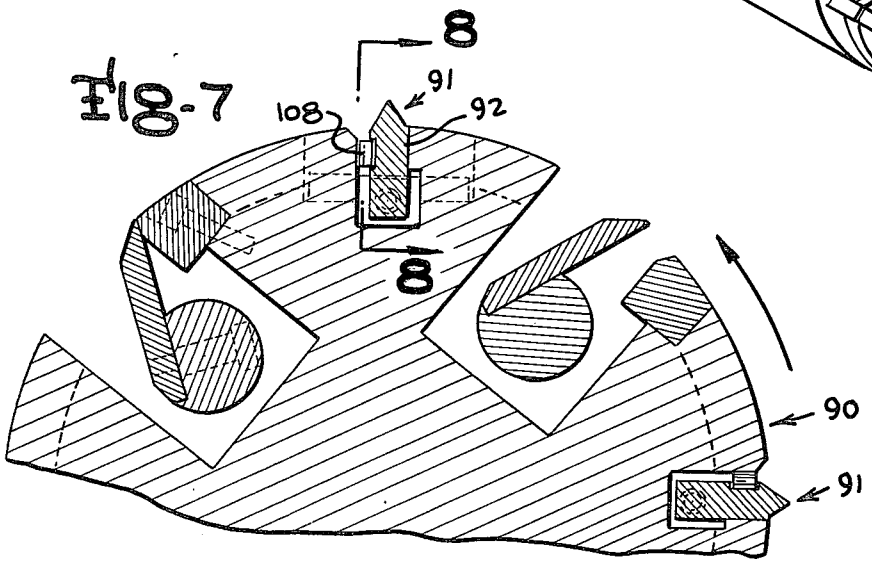
FIG. 7 is a cross-sectional view taken on the line 7—7 of FIG. 6.
Figure 8:
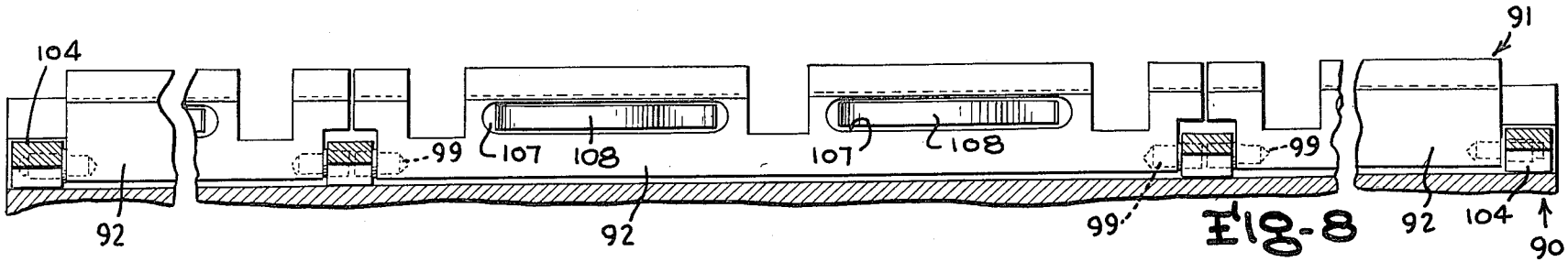
FIG. 8 is a sectional view taken on the line 8—8 of FIG. 7.
Figure 9:
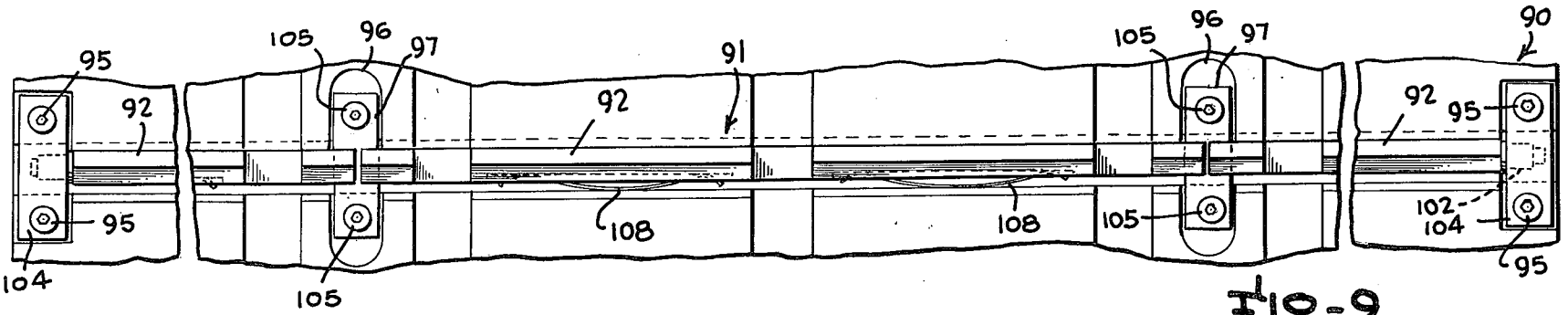
FIG. 9 is a top plan view of the device of FIG. 8.
Figure 10:
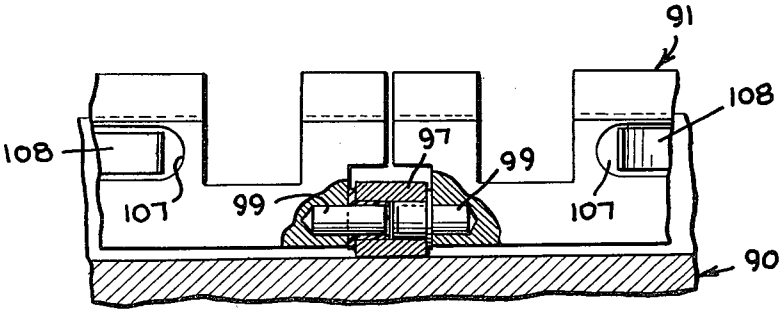
FIG. 10 is an enlarged elevational view showing the ends of two blades and showing their journal means, and with parts broken away and in section for clarity of illustration.

The tuckers 60 have shaft portions 63 on their outer ends, FIG. 5, and these shaft portions 63 are rotatably supported by bearings 64. The bearings 64 include cooperating bearing blocks 65 that have recessed areas 66 therein for the projection therethrough of the shaft portions 63, and securing elements 67 are provided for maintaining the bearing blocks 65 fastened together and for maintaining the bearing blocks anchored in the recess 68 in a roll 22.

Tucker spring brackets 69 are provided as shown in the drawings, and the brackets 69 each have a spring member 70 connected thereto as at 71, and the other end of the spring member 70 is anchored in place to the roll as at 72. Each of the brackets 69 include the bearing portion 74 for receiving an end of the shaft section 63 and securing elements extend through apertures 73 to securely clamp the bracket 69 to the shaft portion 63.

Figure 2:
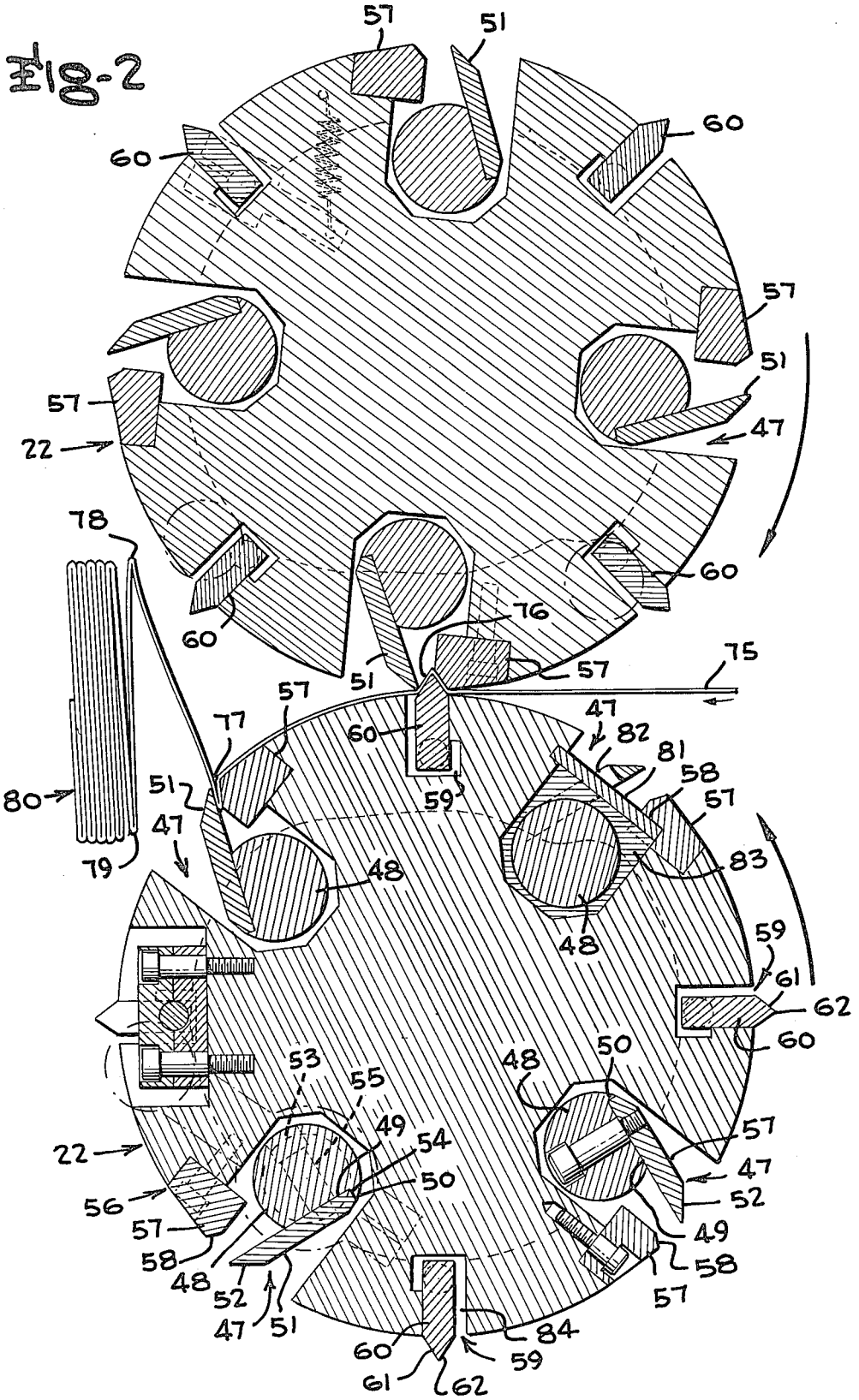
FIG. 2 is a sectional view taken on the line 2—2 of FIG. 1.
Figure 3:
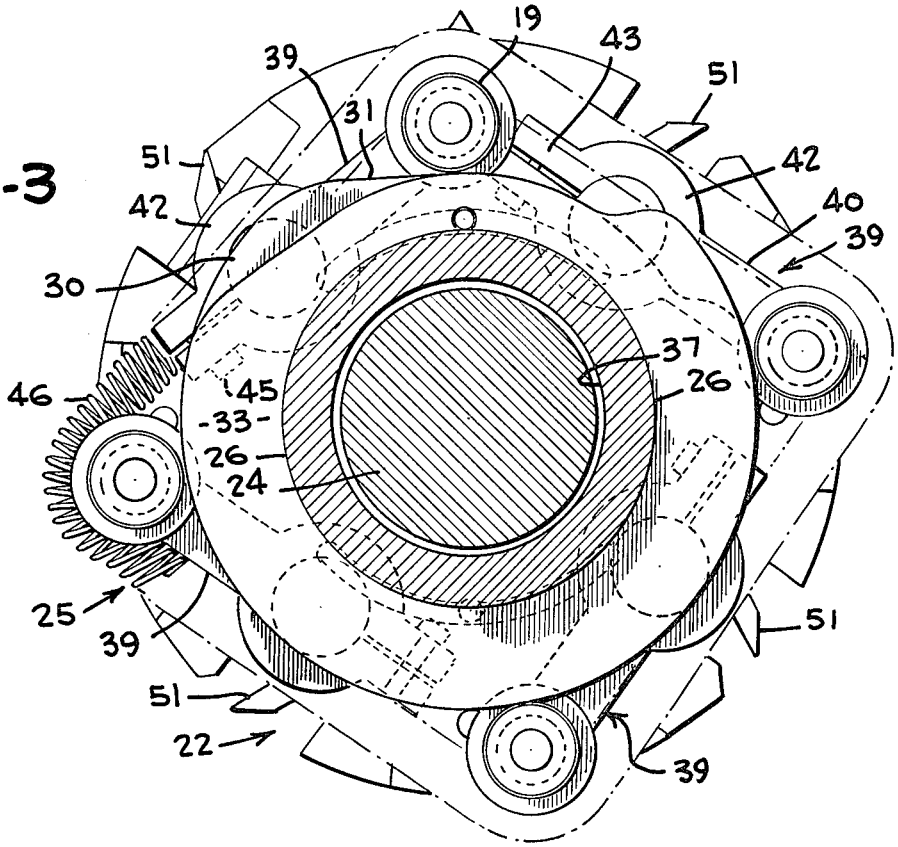
FIG. 3 is a sectional view taken n the line 3—3 of FIG. 1.
Figure 4:
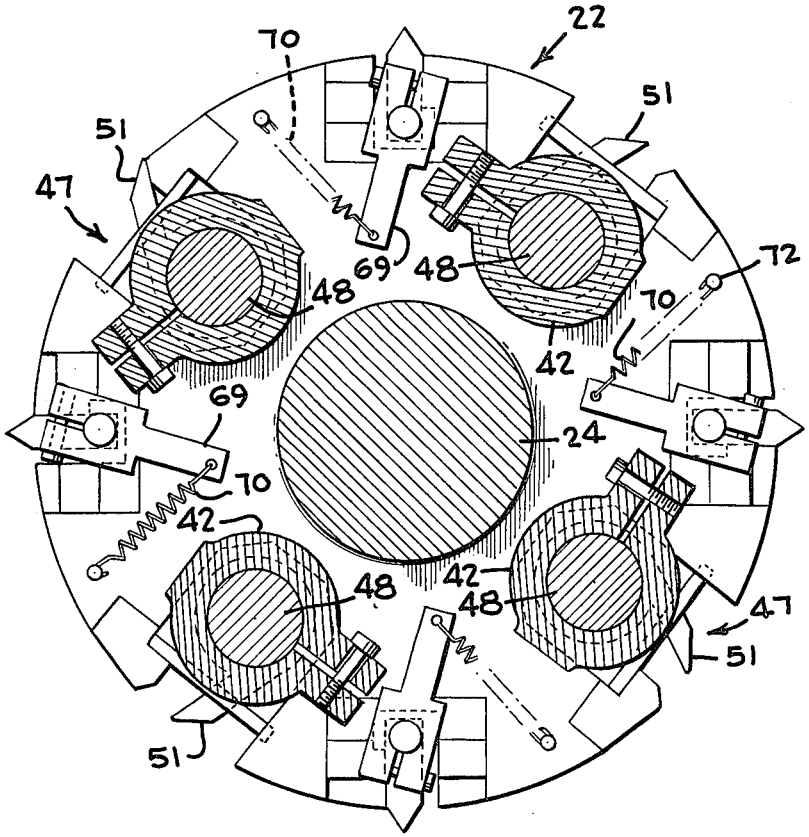
FIG. 4 is a sectional view taken on the line 4—4 of FIG. 1.

In FIG. 2 the numeral 75 indicates paper stock or web material that is fed or supplied from a suitable source of supply from right to left and at point 76 there is indicated the initial forming of a fold by the coacting tucker and gripper. At point 77 there is illustrated the portion of the web being gripped. Numerals 78 and 79 indicate reverse folds or oppositely formed folds in a completed stack of paper toweling 80 or the like.

From the foregoing, it will be seen that there have been provided tuckers on mechanical folding rolls, and in use with the parts arranged as shown in the drawings, the rolls 22 can be driven in the usual manner as for example by means of gears 23. Certain of these conventional elements are known in the prior patents such as U.S. Pat. Nos. 3,195,883; 3,490,762; 1,886,312 and 1,761,517.

When the apparatus is being used to form reversely folded paper towels or the like, as indicated by the numeral 80 in FIG. 2, a continuous web 75 is paessed between the pair of rolls 22, and the rolls 22 rotate in opposite directions relative to each other as indicated by the arrows in FIG. 2. At point 76 in FIG. 2 the tucker 60 on the lower roll 22 is shown tucking the stock 75 into the space between the fixed jaw 57 and the movable jaw 51. While the jaw 51 is in an open position, upon further rotation, the gripper 51 closes and grips the stock 75 and strips it from the tucker blade as at 77. Upon further rotation, the next tucker blade on the gripping roll goes through the same process to form the reverse fold so that reverse folds 78 and 79 are formed in the stack of paper toweling 80. Thus, the present invention functions in a continuous manner to grip the stock 75, strip the stock off of the tucker blade, and upon rotation, drops the stock. The tuckers and grippers on the pair of coacting rolls 22 are arranged in alternate relationship relative to each other so that as shown, for example in FIG. 2, there is a stripper on the top and a tucker on the bottom roll. Then, the next one to react will have the tucker on the top roll and the stripper on the bottom roll and due to this construction, the reverse folds 78 and 79 are formed. Thus, this alternate disposition of the tuckers and grippers causes one fold to be formed in one direction, and the next one is folded in the opposite direction.

The cams such as the cams 25 can be set to open and close the grippers at the proper position so that the previously described action can take place in the proper manner. Further, the cams can be adjusted, as for example, by means of the securing elements 35 and 28 that pass through their respective slots so that the cams can be set to function in the proper manner. The springs 70 serve to keep constant spring pressure on the tuckers 60.

It will be understood that by means of the present invention, a stack of paper towels 80 with the reverse or opposite fold 78 and 79 can be formed in a most advantageous and efficient manner and at minimum cost. While the present invention has been illustrated and described for use in forming paper towels having reverse or opposite folds, it is to be understood that the present invention can be used in handling for forming other types of products besides paper toweling.

The parts can be made of any suitable material and in different shapes or sizes as desired or required.

The present invention relates to the folding of materials such as paper hand toweling in either a single fold ("V fold") or multiple fold ("Z fold") configuration. In either case, the paper 75 is forced by a tucker 60 into a vise which consists of one stationary jaw 57 and one movable jaw 51 operated by a cam 25 on opening and a spring on closing. In the present application the movable vise is leading through the roll nip.

The tucker 60 on the bottom roll enters the vise on the top roll and the vise strips the sheet 75 from the tucker 60 to make the first fold as at FIG. 2. Then the tucker 60 on the top roll enters the vise on the bottom roll as they rotate to make another fold. With a fixed tucker on this type of design, there must be provided a clearance at all times between the fixed vise and the tucker or there is direct mechanical interference. As the rolls 22 wear or the roll centers are changed, this clearance changes. If the rolls 22 are rotated relative to each other (timed), the clearance between the first tucker and the fixed vise can be decreased, but the next entering tucker-vise combination will increase the same amount. Thus, the only way to compensate for this is to shim the tuckers out of the rolls and retime to control the clearance. If this clearance becomes too great, the sheet such as the sheet 75 will tend to follow the tucker 60 back out of the vise as the folls rotate and cause a "dropped" fold. This becoms more common at higher speeds. Further, such shimming of the tuckers is a time-consuming procedure or operation.

With the present invention, the tucker blade is especially constructed and designed to interfere several thousandths of an inch with the fixed anvil, and it can push away due to the spring loading. This makes the timing of the two rolls 22 less critical for paper basis weight changes. It also traps the sheet 75 between the fixed vise and the tucker 60 so that the sheet 75 is less likely to follow the tucker as the tucker leaves the vise. This causes less "dropped" folds. Further, this eliminates the possibility of direct mechanical interference and allows running at higher speeds so as to provide greater efficiency.

As shown in FIG. 2, a retaining strap or bar 81 can extend through a slot 82 in a movable jaw 51, and the retaining strap 81 abuts a bearing 83 so as to assure that these parts will be clamped or held in their proper assembled position.

It is to be understood that thd shaft portions 63 are connected to the tuckers 60 so that the tuckers 60 can pivot about an axis extending through the shaft portions 63, and it will be noted as shown in FIG. 2, for example, that there is a slight clearance space 84 between one side of a tucker 60 and groove 59. The spring 70 is connected to the bracket 69, and the bracket 69 is clamped as at 74 to the shaft portions 63 so that the springs 70 serve to keep constant spring pressure on the tuckers 60.

Attention is now directed to FIGS. 6 through 10 of the drawings, wherein there is illustrated tucker blades that are split into individual segments the width of one towel rather than the full width of the machine. Further, with the arrangement of FIGS. 6 through 10, two leaf springs per segment are utilized rather than the extension springs on each end of the blade. The advantage of this is in the difficulty of machining one long blade without warpage, and replacement of one small segment in case of damage. Further, each segment can compensate for a variation in paper thickness across the machine whereas with one blade the thickest material controlled the entire blade.

With further reference to the alternative or modified construction shown in FIGS. 6 through 10, the numeral 90 indicates rolls having tuckers 91 mounted therein, and the tuckers 91 are segmented or split to provide segments 92. Shaft portions 102 on the ends of the tuckers 91 are journalled in or received in openings 103 in bearings 104 and the bearings 104 have apertures 94 for the projection therethrough of securing elements 95, FIG. 9. The recesses 93 in the end portion of the rolls 90 snugly receive the bearings 104.

Shaft sections 99 are provided on the inner ends of the tucker segment 92, and recesses 96 in the rolls 90 snugly receive bearings 97. The bearings 97 have openings 98 for receiving the shaft sections 99. The bearings 97 are provided with apertures 106 for the projection therethrough of securing elements 105 for maintaining these parts in their proper assembled position. The tucker segments 92 are further provided with slots 107 for snugly receiving therein leaf springs 108 for a purpose to be later described.

It will therefore be seen in accordance with the present invention as illustrated in FIGS. 6 through 10, the tucker blade 91 has been split into individual segments 92 which have a length equal to the width of one towel being handled such as a paper towel, rather than the tucker being the full width of the machine as indicated by the numeral 60 in FIGS. 1 through 5. Further, with the construction shown in FIGS. 6 through 10, two leaf springs, 108, are used for each segment 92, rather than using the extension springs on each end of the blade. The advantage of this construction is that there is overcome the difficulty of machining one long blade such as the blade 60 so that warpage is prevented. Furthermore, replacement of one small segment such as a segment 92 in case of damage can be readily accomplished, and each segment 92 can compensate for variation in paper thickness across the machine whereas with one blade such as the one blade 60, the thickest material controls the entire blade.

The leaf springs 108 bear against the tucker segments 92 to bias or urge the tucker segments in the proper direction. By having the tucker made of a plurality of segments 92, in the event that it is necessary to make a replacement, only one of the segments need be replaced instead of replacing the entire tucker, as in the case with the previously described tucker 60. Thus, in FIGS. 1 through 5 the tucker blade extends the full length of the cylinder and the tucker 60 is urged to one side by springs located at each end. In the form of the invention shown in the FIGS. 6 through 10, the tucker blade is segmented according to the width of the number of towels for each cylinder. The segmented tucker blades are all journalled on a common axis but are individually urged to one side of its slot by means of a plurality of leaf springs 108. The shaft sections or dowels 99 are arranged and constructed as shown in the drawings. Two leaf springs 108 are provided for each tucker segment, and there is provided a slot or recess 107 for each leaf spring 108.

Otherwise, the construction and operation of the assembly shown in FIGS. 6 through 10 is the same as that shown in FIGS. 1 through 5.

Additional embodiments of the invention in this specification will occur to others and, therefore, it is intended that the scope of the invention be limited only by the appended claims and not by the embodiments described hereinabove. Accordingly, reference should be made to the following claims in determining the full scope of the invention.

What is claimed is:

1. In a paper folding machine for towels, paper napkins and the like, having a width, said paper folding machine including a frame, a pair of first and second co-acting oppositely rotating rolls supported in said frame, means for rotating said rolls in opposite directions relative to one another, cam means operatively connected to each of said rolls, each of said rolls including cooperating tuckers and grippers, said grippers, including a stationary jaw and a movable jaw, the tuckers and grippers on said rolls being arranged in alternate locations relative to each other along the periphery of said rolls;

the improvements which comprise including in said machine;

a plurality of longitudinally extending recesses in each of said rolls;

gripper shafts mounted in said recesses, each said movable jaw being mounted on one of said gripper shafts;

each of said stationary jaws being disposed in the trailing portion of one of said longitudinally extending recesses, facing one of said movable jaws, each of said stationary jaws being provided with a bevelled surface opposed to a working face on said movable jaw;

longitudinally extending L-shaped grooves on each of said rolls between each of said longitudinally extending recesses, each of said tuckers being mounted in one of said L-shaped grooves;

each of said tuckers terminating in a tip having an inclined face along its trailing edge;

spring means to resiliently urge said inclined face toward the bevelled portion of said fixed jaw when said tucker and said gripper are brought into engagement by rotation of said oppositely rotating rolls;

each of said tuckers including a tucker blade comprising individual segments, each of which has a length equal to the width of the paper article to be folded;

and wherein said segments are provided with slots, and including a pair of leaf springs received in said slots exerting pressure on said segments to pivot the same.

2. The structure as defined in claim 1, and further including shaft portions on the ends of said segments, bearings for receiving said shaft portions, and there being recesses in said rolls for receiving said bearings.

* * * * *